US007632130B2

(12) United States Patent
Sami

(10) Patent No.: US 7,632,130 B2
(45) Date of Patent: Dec. 15, 2009

(54) ELECTRICAL CONNECTOR AND CONNECTOR ASSEMBLY HAVING INNER AND OUTER PLUG HOUSINGS

(75) Inventor: Toshiyuki Sami, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/174,784

(22) Filed: Jul. 17, 2008

(65) Prior Publication Data

US 2009/0029584 A1 Jan. 29, 2009

(30) Foreign Application Priority Data

Jul. 27, 2007 (JP) ..... 2007-196466

(51) Int. Cl.
*H01R 13/627* (2006.01)

(52) U.S. Cl. ..... 439/352; 439/357

(58) Field of Classification Search ..... 439/352, 439/353, 355, 357
See application file for complete search history.

(56) References Cited

U.S. PATENT DOCUMENTS

| | | | | |
|---|---|---|---|---|
| 3,569,903 | A * | 3/1971 | Brishka | 439/352 |
| 3,680,033 | A * | 7/1972 | Kawai | 439/352 |
| 4,390,222 | A * | 6/1983 | Carter | 439/258 |
| 5,176,533 | A * | 1/1993 | Sakurai et al. | 439/352 |
| 5,637,010 | A * | 6/1997 | Jost et al. | 439/352 |
| 5,807,129 | A * | 9/1998 | Konda et al. | 439/348 |
| 6,517,373 | B2 * | 2/2003 | Finke et al. | 439/352 |
| 7,322,846 | B2 * | 1/2008 | Camelio | 439/352 |
| 2007/0105417 | A1 | 5/2007 | Camelio | |

FOREIGN PATENT DOCUMENTS

| | | |
|---|---|---|
| EP | 0715372 A1 | 6/1996 |
| EP | 1282202 A1 | 2/2003 |
| FR | 2003198 | 11/1969 |
| JP | 2001-214993 | 8/2001 |

* cited by examiner

*Primary Examiner*—Tho D Ta
(74) *Attorney, Agent, or Firm*—Barley Snyder LLC

(57) ABSTRACT

An electrical connector includes an inner plug housing having a front end portion that is received in a hood of a receptacle connector. The hood has at least one engaging member extending there from. An outer plug housing at least partially surrounds the hood. The outer plug housing is displaceable relative to the inner plug housing in a direction of insertion and removal of the inner plug housing from the hood. At least one engaging arm extends in a space between the outer plug housing and the inner plug housing that engages the engaging member on the hood. The outer plug housing has an engagement release portion opposing the engaging arm that interferes with the engaging arm to disengage the engaging arm from the engaging member when the outer plug housing is moved in the direction of removal of the inner plug housing from the hood.

11 Claims, 16 Drawing Sheets

ELECTRICAL CONNECTOR AND CONNECTOR ASSEMBLY HAVING INNER AND OUTER PLUG HOUSINGS

CROSS-REFERENCE TO RELATED APPLICATIONS

This application claims the benefit of the filing date under 35 U.S.C. § 119(a)-(d) of Japanese Patent Application No. 2007-196466, filed Jul. 27, 2007.

FIELD OF THE INVENTION

The present invention relates to an electrical connector and a connector assembly comprising an inner plug housing having a front end portion that is received in a hood of a receptacle connector and an outer plug housing displaceable relative to the inner plug housing in a direction of insertion and removal of the inner plug housing from the hood.

BACKGROUND

There is widely known a kind of an electrical connector that has a function of preventing disconnection of the electrical connector from a mating connector. For example, Japanese Patent Application Publication No. 2001-214993 describes an electrical connector having a lock ring instead of a nut screwed onto a male screw of a mating connector. The lock ring has plural flexible projecting sections that are pressed in the direction of the center of the lock ring by a coupling sleeve provided at a position corresponding to the outer periphery of the front end of the lock ring and are engaged with the male screw of the mating connector, when the electrical connector is coupled to the mating connector. When only the coupling sleeve is pulled in the direction of disconnecting the electrical connector, force applied to the projecting sections is released and thereby the electrical connector can be disconnected from the mating connector.

However, when an operator disconnects the electrical connector, as described in Japanese Patent Application Publication No. 2001-214993, from the mating connector, the operator, for example, needs to keep the coupling sleeve in the pulled condition with one hand and move the electrical connector with the other hand in the direction of disconnection. Thus, the operator needs to use both hands to disconnect the electrical connector, which deteriorates working efficiency. In addition, when the above electrical connector and the mating connector are coupled to each other, there may be housings where the electrical connector is disconnected from the mating connector due to vibration or unintentional touching of the coupling sleeve by an object.

SUMMARY

In view of the circumstances described above, it is an object of the present invention to provide an electrical connector and a connector assembly that are capable of being operated with one hand and preventing inadvertent disconnection of the electrical connector.

This and other objects are achieved by an electrical connector comprising an inner plug housing having a front end portion that is received in a hood of a receptacle connector. The hood has at least one engaging member extending there from. An outer plug housing at least partially surrounds the hood. The outer plug housing is displaceable relative to the inner plug housing in a direction of insertion and removal of the inner plug housing from the hood. At least one engaging arm extends in a space between the outer plug housing and the inner plug housing that engages the engaging member on the hood. The outer plug housing has an engagement release portion opposing the engaging arm that interferes with the engaging arm to disengage the engaging arm from the engaging member when the outer plug housing is moved in the direction of removal of the inner plug housing from the hood.

DETAILED DESCRIPTION OF THE EMBODIMENT(S)

Figure 1:
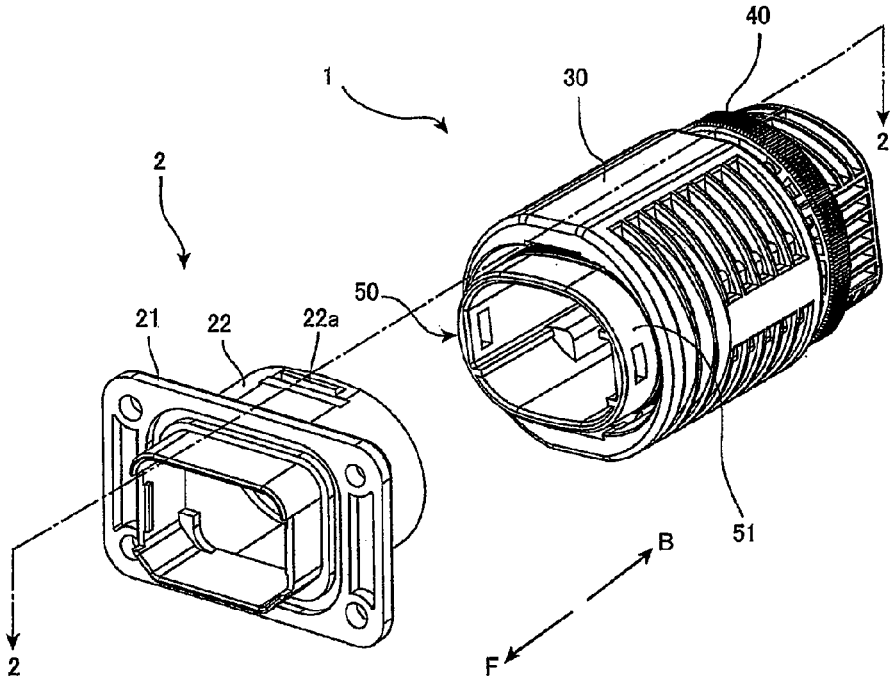
FIG. 1 is a perspective view of a plug connector according to a first embodiment of an electrical connector of the present invention.
Figure 2:
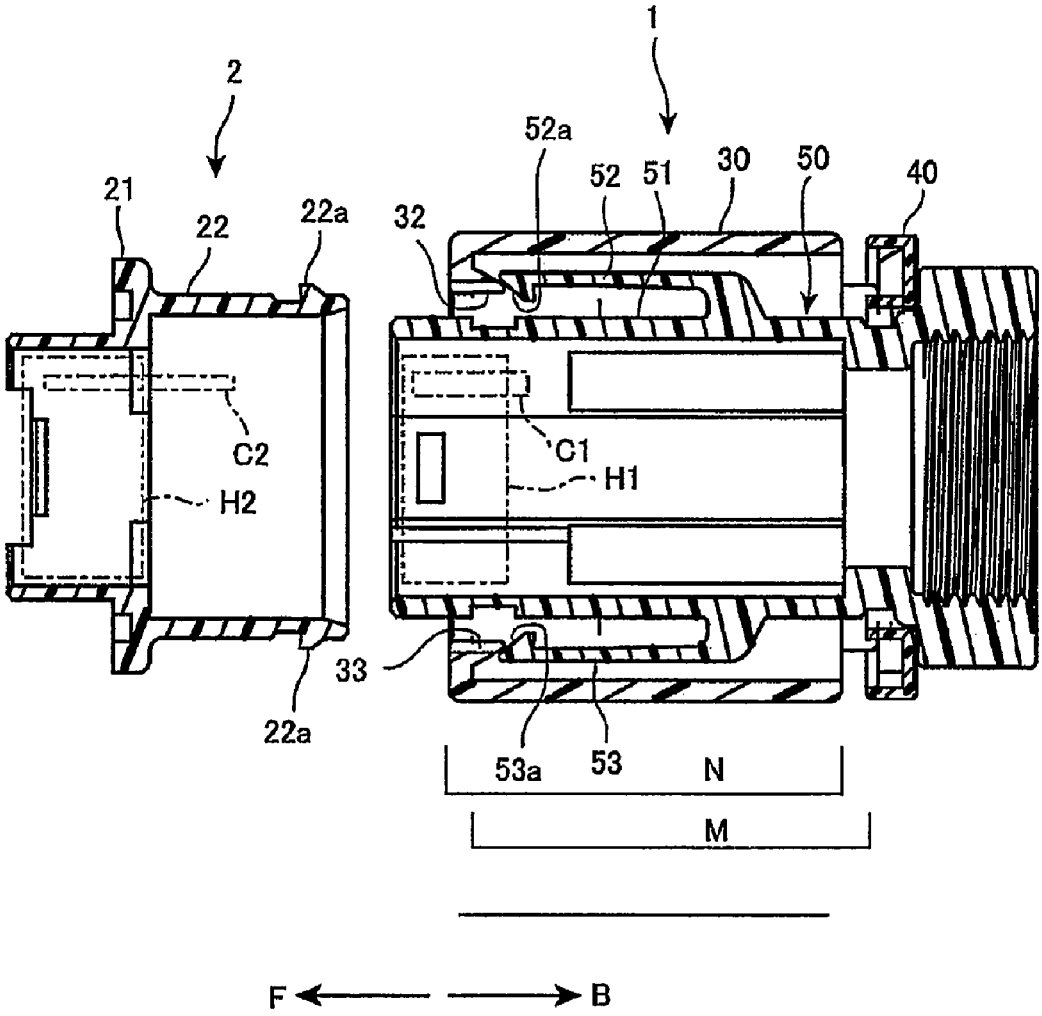
FIG. 2 is a sectional view of the plug connector shown in FIG. 1.

FIGS. 1-8 show a plug connector 1 according to a first embodiment of an electrical connector of the present invention. As shown in FIGS. 1-2, in use, the plug connector 1 is attached to an end of a cable while a receptacle connector 2 is attached to a panel or the like. The plug connector 1 and the receptacle connector 2 are coupled to each other, thereby forming a connector assembly. As shown in FIG. 2, when coupled, contacts C1 disposed in the plug connector 1 and contacts C2 disposed inside the receptacle connector 2 are electrically connected to each other. As it is expected that the receptacle connector 2 is to be attached to a mobile device as well as a stationary device, the plug connector 1 should be formed to be easily coupled to and removed from the receptacle connector 2 while still being restrained from inadvertent disconnection. It should be noted that in this embodiment a direction in which the plug connector 1 is inserted into the receptacle connector 2 is referred to as direction F (front) and the direction opposite to the direction F is referred to as direction B (back).

Figure 3:
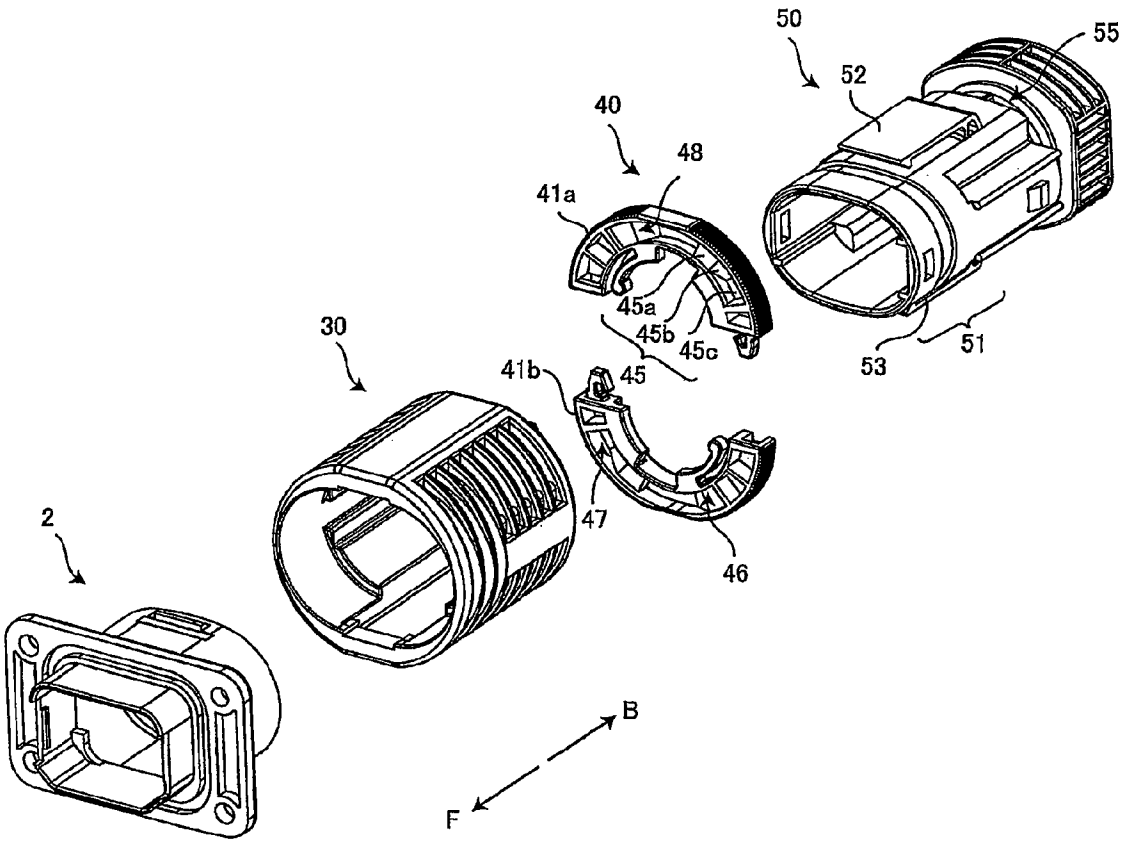
FIG. 3 is an exploded perspective view of the plug connector shown in FIG. 1.

As shown in FIGS. 1-3, the plug connector 1 has a so-called push-pull lock mechanism including a inner plug housing 50 configured to be inserted into and removed from the receptacle connector 2, a outer plug housing 30 configured as a tubular member that surrounds the inner plug housing 50 and is movable in the direction F and the direction B, and an annular lock ring 40 configured as a displacement stop member that prevents displacement of the outer plug housing 30. The receptacle connector 2 has a flange 21 configured to fix the receptacle connector 2 to a panel of a device and a hood 22 into which the inner plug housing 50 of the plug connector 1 is inserted. Engaging members 22*a* are formed as an engaging section on an external wall of the hood 22. In the illustrated embodiment, the engaging members 22*a* are illustrated as claws. A housing core H2 of the receptacle connector 2 houses the contacts C2 provided in the receptacle connector 2.

The inner plug housing 50 of the plug connector 1 is substantially tubular and includes a housing core H1 formed inside thereof that accommodates the contacts C1. The inner plug housing 50 has a front end 51 formed at a front thereof in the direction F, which is configured to be inserted into the hood 22 of the receptacle connector 2. The housing core H1 is disposed at an inside of the front end 51 of the inner plug housing 50. Engaging arms 52, 53 extend in the direction F along an external wall of the inner plug housing 50. The engaging arms 52, 53 extend between the inner plug housing 50 and the outer plug housing 30 and have protrusions formed on the front end portions 52*a*, 53*a* thereof. When the plug connector 1 and the receptacle connector 2 are coupled to each other, the front end portions 52*a*, 53*a* of the engaging arms 52, 53 engage with the engaging members 22*a* of the hood 22, thereby preventing the plug connector 1 from disconnection.

The outer plug housing 30 is substantially tubular and surrounds the inner plug housing 50. The outer plug housing 30 has an inside diameter long enough to allow the outer plug housing 30 to surround the hood 22 of the receptacle connector 2. When the plug connector 1 and the receptacle connector 2 are coupled to each other, the hood 22 of receptacle connector 2 is interposed between the inner plug housing 50 and the outer plug housing 30. The outer plug housing 30 is held by the inner plug housing 50 such that outer plug housing 30 can be displaced between a neutral position N and a release position M that is further back in the direction B than the neutral position N, as shown in FIG. 2. On the front end of the outer plug housing 30, engagement release portions 32, 32 are formed that are bent inward to project toward the direction B. The engagement release portions 32, 32 are placed so as to be opposed to the front end portions 52*a*, 53*a* of the engaging arms 52, 53 that are directed to the direction F.

When the outer plug housing 30 is caused to slide in the direction B to the release position M by operation, the engagement release portions 32, 33 interfere with the engaging arms 52, 53. When the engagement release portions 32, 33 interfere with the engaging arms 52, 53, while the plug connector 1 and the receptacle connector 2 are mated, the engaging arms 52, 53 are disengaged from the engaging members 22*a*. In addition, when the outer plug housing 30 moves toward the direction B, inclined surfaces respectively formed on the engagement release portions 32, 33 press the engaging arms 52,53 in the direction in which the engaging arms 52, 53 are separated from each other. Thus, the outer plug housing 30 is pushed toward the direction F by elastic force of the engaging arms 52, 53, and returned to the neutral position N without any operation. The lock ring 40 restricts the displacement of the outer plug housing 30 toward the direction B.

Figure 4:
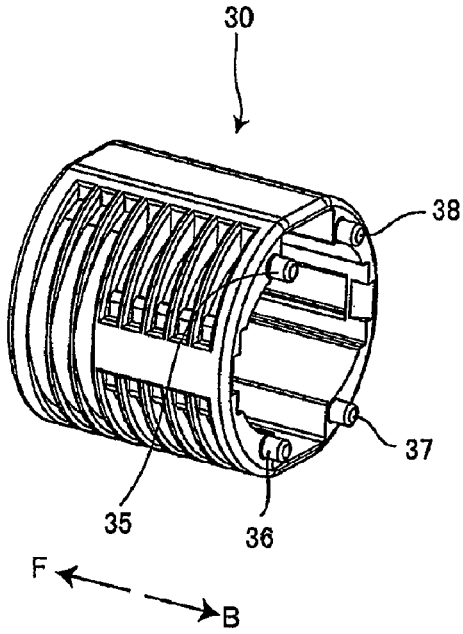
FIG. 4 is a perspective view of an outer plug housing of the plug connector shown in FIG. 1 as viewed from a back thereof.
Figure 5:
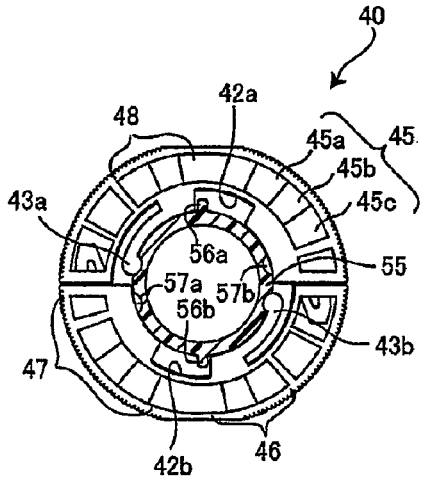
FIG. 5 is a plan view of a lock ring of the plug connector shown in FIG. 1 as viewed from a front thereof.
Figure 6:
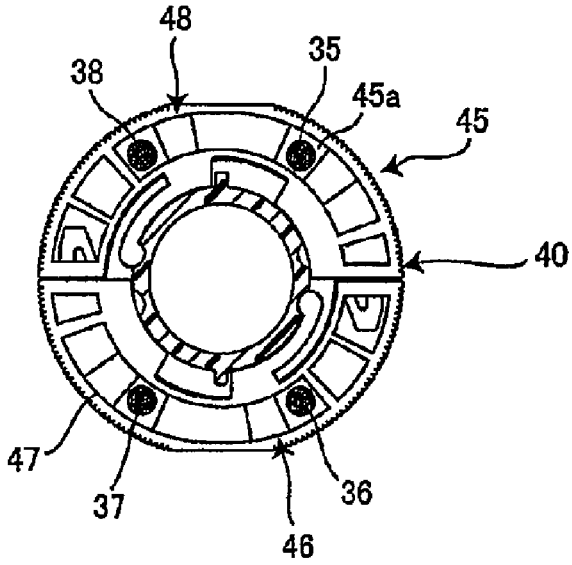
FIG. 6(A) is a plan view of the lock ring of the plug connector shown in FIG. 1 shown in a stop position.
FIG. 6(B) is a plan view of the lock ring of the plug connector shown in FIG. 1 shown in a stop release position.
Figure 6:
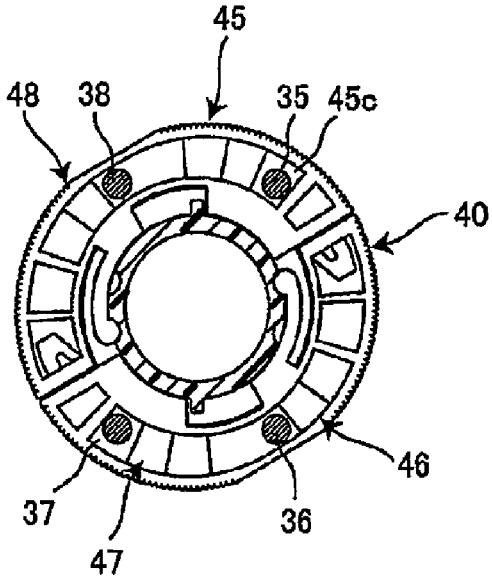

As shown in FIG. 4, cam pins 35, 36, 37, 38 that project toward direction B are provided on the rear end of the outer plug housing 30. The cam pins 35, 36, 37, 38 are caused to abut against the lock ring 40. As shown in FIG. 3, the lock ring 40 that rotates around the inner plug housing 50 is formed by fitting two ring members 41*a*, 41*b* that have a semicircle arc form, into a groove 55 formed in the inner plug housing 50. As shown in FIG. 5, cutouts 42*a*, 42*b* are formed in the lock ring 40 to regulate a rotation angle of the lock ring 40. Click arms 43*a*, 43*b* cause a click sensation during rotation of the lock ring 40. The lock ring 40 further has cam surface 45, 46, 47, 48 corresponding to the cam pins 35, 36, 37, 38 of the outer plug housing 30. The cam surface 45 is further formed by a front surface 45*a*, a back surface 45*c*, and an inclined surface 45*b* that is interposed between the front surface 45*a* and the back surface 45*c*. Similarly, the cam surfaces 46, 47, 48 are formed by three surfaces similar to the cam surface 45.

As shown in FIG. 5, protrusions 56*a*, 56*b* correspond to the cutouts 42*a*, 42*b* and recesses 57*a*, 57*b* corresponding to the click arms 43*a*, 43*b* are formed on the groove 55 of the inner plug housing 50. The lock ring 40 rotates about the inner plug housing 50 about an axis that extends in the direction F-B. The rotation angle of the lock ring 40 is regulated within about 30 degrees by the cutouts 42*a*, 42*b* and the protrusion 56*a*, 56*b*. In addition, fitting of the click arms 43*a*, 43*b* into the recesses 57*a*, 57*b* generates a click sensation and positions the lock ring 40.

Figure 7:
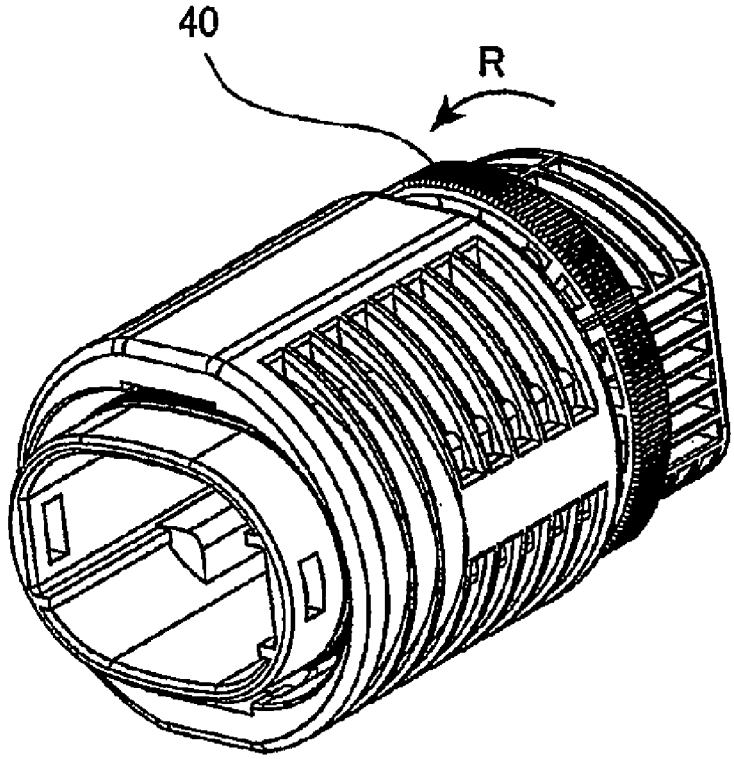
FIG. 7 is a perspective view of the plug connector shown in FIG. 1 showing a state in which the lock ring is being rotated.
Figure 8:
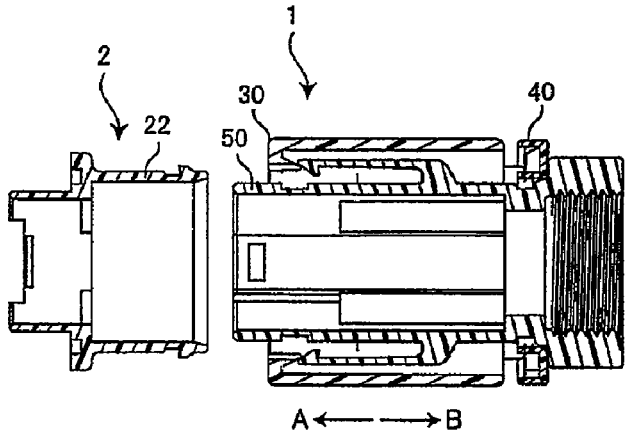
FIG. 8(A) is a sectional view sectional of a process in which the plug connector shown in FIG. 1 is coupled to and disconnected from a receptacle connector.
FIG. 8(B) is a sectional view sectional of a process in which the plug connector shown in FIG. 1 is coupled to and disconnected from a receptacle connector.
FIG. 8(C) is a sectional view sectional of a process in which the plug connector shown in FIG. 1 is coupled to and disconnected from a receptacle connector.
FIG. 8(D) is a sectional view sectional of a process in which the plug connector shown in FIG. 1 is coupled to and disconnected from a receptacle connector.
Figure 8:
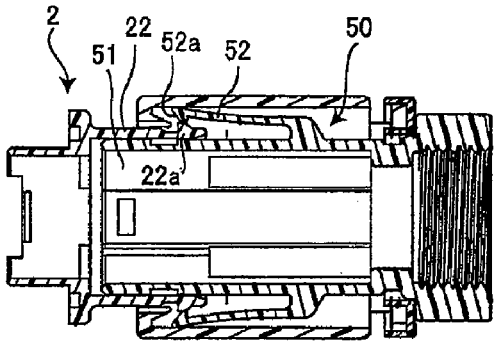
Figure 8:
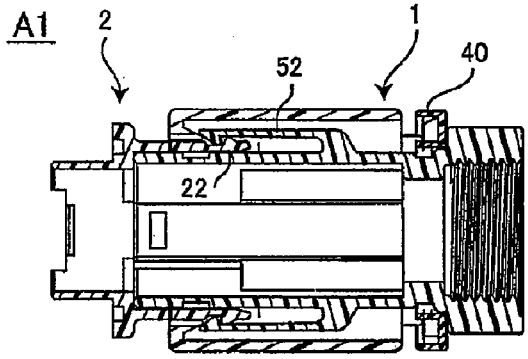
Figure 8:
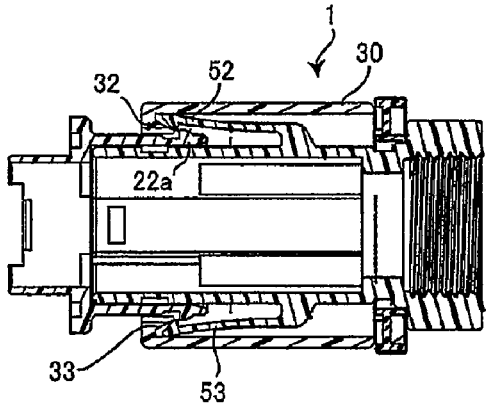

FIGS. 6(A)-6(B) illustrate a state in which the cam pins 35-38 of the outer plug housing 30 abut against the lock ring 40 shown in FIG. 5. FIG. 6(A) shows the stop position of the lock ring 40, while FIG. 6(B) shows the stop release position. FIG. 7 shows a state in which the lock ring 40 is being rotated. The lock ring 40 is held by the inner plug housing 50 so as to be displaceable between the stop position shown in FIG. 6(A) and the stop release position shown in FIG. 6(B). In the stop position shown in FIG. 6(A), the cam pin 35 is caused to abut against the front surface 45*a* of the cam surface 45. Similarly, the cam pins 36, 37, 38 are caused to abut against corresponding front surfaces of the cam surfaces 46, 47, 48. In this state, the outer plug housing 30 is in the neutral position N (FIG. 2), the cam pins 36, 37, 38 of the outer plug housing 30 are abutted against the cam surfaces 46, 47, 48 and displacement of the outer plug housing 30 toward the direction B is stopped.

When the lock ring 40 is turned to the direction indicated by arrow R of FIG. 7 by the operation of an operator, the lock ring 40 reaches the stop release position shown in FIG. 6(B). In the stop release position shown in FIG. 6(B), the cam pin 35 is opposed to the back surface 45*c* of the cam surface 45. Similarly, the cam pins 36, 37, 38 are respectively opposed to corresponding surfaces of the cam surfaces 46, 47, 48. In the stop release position, the cam surfaces 45, 46, 47, 48 are separated from the cam pins 35, 36, 38. Thus, the outer plug housing 30 is released from the stop position and prevents displacement of the outer plug housing 30 toward direction B. Accordingly, the outer plug housing 30 can move by the operation of the operator from the neutral position N to the release position M (FIG. 2) where the cam pins 35, 36, 37, 38 of the outer plug housing 30 abut the cam surfaces 45, 46, 47, 48 again (the back surface 45*c*).

FIGS. 8(A)-8(D) are sectional views showing a process of connection and disconnection of the plug connector 1 and the receptacle connector 2 shown in FIG. 1. FIGS. 8(A)-8(D) sequentially show the process in which the plug connector 1 is coupled to and disconnected from the receptacle connector 2. When the plug connector 1 and the receptacle connector 2 shown in FIG. 8(A) are to be coupled to each other, the hood 22 of the receptacle connector 2 enters a tubular gap between the inner plug housing 50 and the outer plug housing 30. Incidentally, the lock ring 40 may be in either of the stop position (FIG. 6(A)) or the stop release position (FIG. 6(B)). When the plug connector 1 and the receptacle connector 2 are to be coupled to each other, the outer plug housing 30 is in the neutral position N (FIG. 2) and is pushed forward in the direction F, irrespective of whether the lock ring 40 is in the stop position or the stop release position.

As shown in FIG. 8(B), when the front end 51 of the inner plug housing 50 is inserted into the hood 22, the front end portions 52*a*, 53*a* of the engaging arms 52, 53, respectively go over the engaging members 22*a* of the hood 22, and, as shown in FIG. 8(C), are engaged with the engaging members 22*a*. Engagement of the engaging arms 52, 53 with the engaging members 22*a* prevents the plug connector 1 from being disconnected from the receptacle connector 2. FIG. 8(C) shows a finished connector assembly A1 in which the plug connector 1 is coupled to the receptacle connector 2.

If the lock ring 40 is in the stop position (FIG. 6(A)) while the plug connector 1 is mated with the receptacle connector 2, as shown in FIG. 8(C), disconnection of the plug connector 1 is surely prevented because the outer plug housing 30 is restrained from moving to the release position M (FIG. 2). When the lock ring 40 is rotated by operation to shift to the stop release position (FIG. 6(B)), the outer plug housing 30 becomes displaceable toward the direction B. When the outer plug housing 30 is moved toward the direction B to the release position M, as shown in FIG. 8(D), by operation, the engagement release portions 32, 33 interfere with the engaging arms 52, 53, thereby disengaging the engaging arms 52, 53 from the engaging members 22*a*. Pulling the outer plug housing 30 in the state shown in FIG. 8(D) further toward the direction B by operation disconnects the plug connector 1 from the receptacle connector 2.

FIGS. 9-13 show a plug connector 201 according to a second embodiment of an electrical connector of the present invention. In the descriptions of the second embodiment, the same elements as those in the first embodiment are designated as identical reference symbols and only the features different from the first embodiment will be described.

Figure 9:
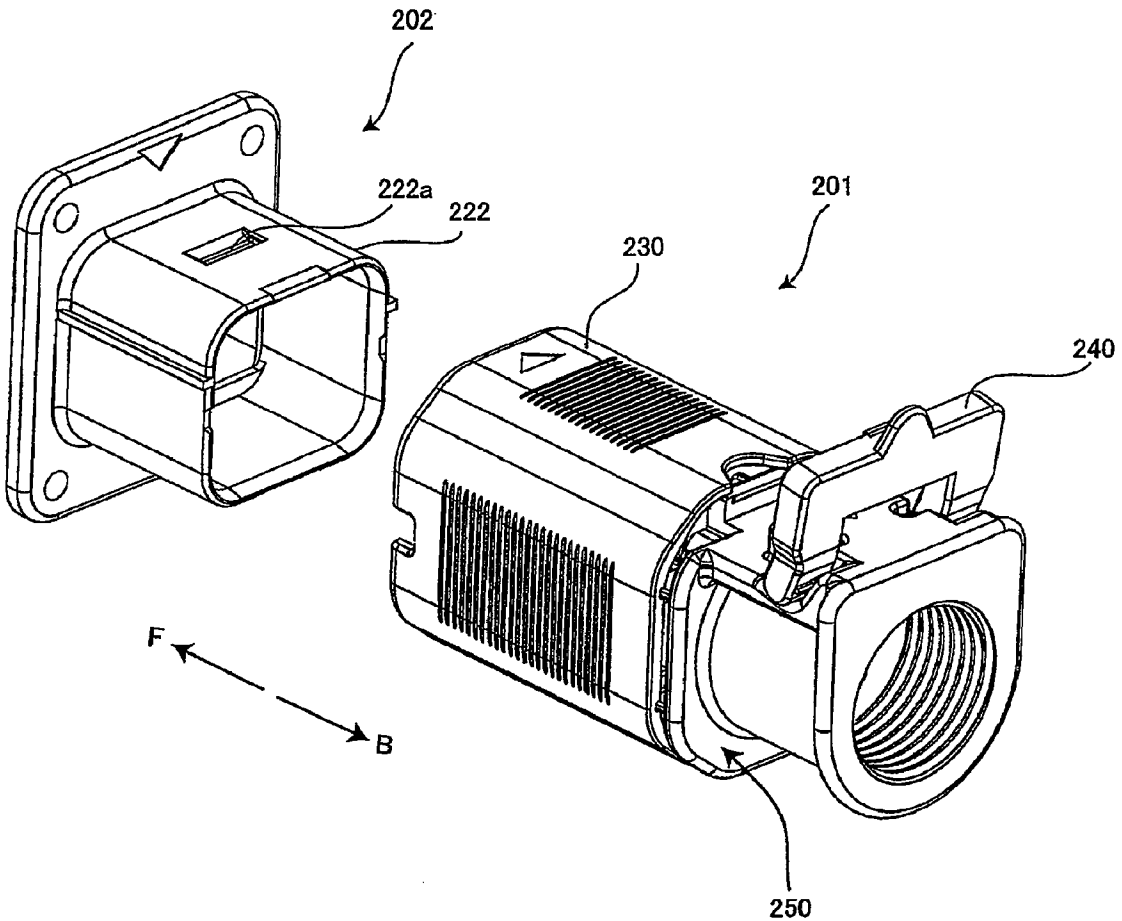
FIG. 9 is a perspective view of a plug connector according to a second embodiment of an electrical connector of the present invention.
Figure 10:
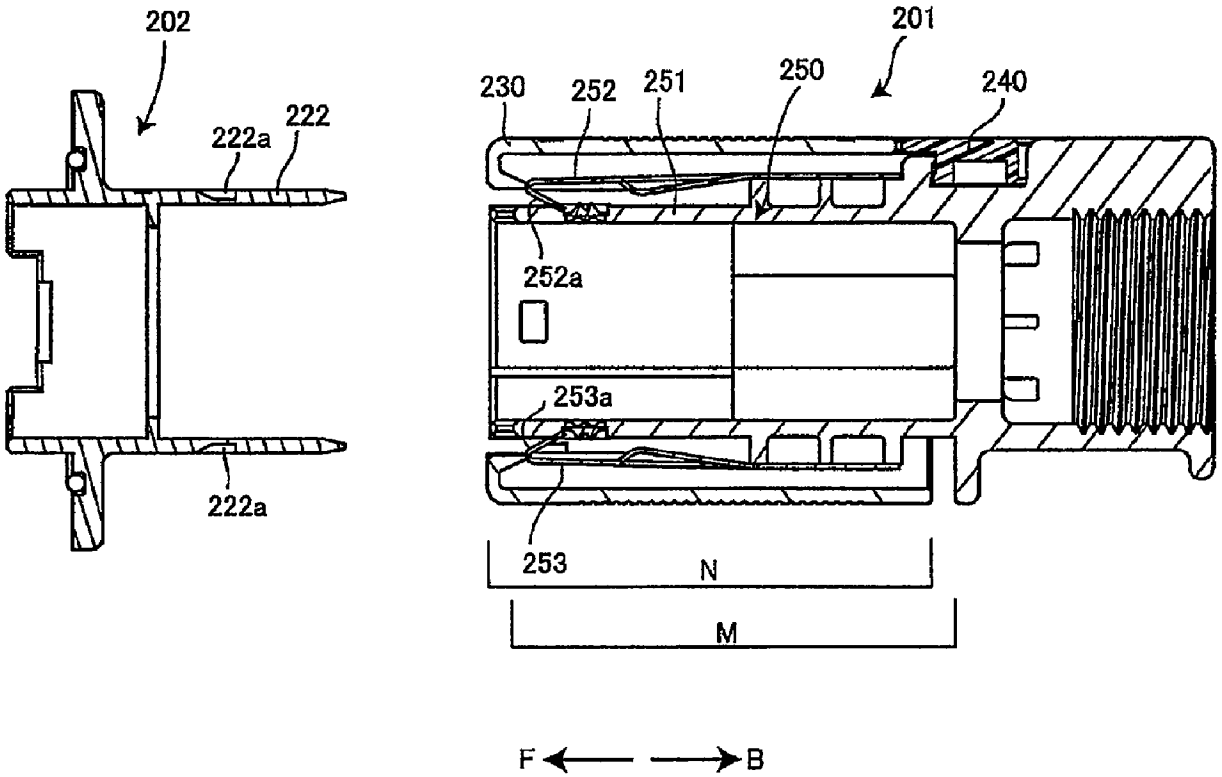
FIG. 10 is a sectional view showing the plug connector shown in FIG. 9.

A connector assembly A2 (FIGS. 11-12) is formed by coupling the plug connector 201 to a receptacle connector 202, as shown in FIGS. 9-10. The plug connector 201 is of push-pull type with locking function and includes a inner plug housing 250 configured to be inserted into the receptacle connector 202, a outer plug housing 230 formed outside the inner plug housing 250 so as to be movable in the direction F and the direction B, and a stopper 240 configured to prevent movement of the outer plug housing 230. The receptacle connector 202 has a hood 222 configured for insertion of the inner plug housing 250. Engaging members 222*a* are formed in the outer wall of the hood 222. In the illustrated embodiment, the engaging members 222*a* are formed as engaging dents.

The inner plug housing 250 of the plug connector 201 is substantially tubular and has a front end 251 that is inserted into the hood 222 of the receptacle connector 202. The inner plug housing 250 has engaging arms 252, 253 that extend in the direction F along an outer surface of the front end 251. On each front end portion 252*a*, 253*a* of the engaging arms 252, 253, a hook is formed that fits into each of the engaging members 222*a* of the hood 222 when the plug connector 201 and the receptacle connector 202 are coupled to each other. The engaging arms 252, 253 are fitted in the engaging members 222*a* to prevent the plug connector 201 from disconnection.

The outer plug housing 230 is held such that it is displaceable relative to the inner plug housing 250 in the direction F and in the direction B. On the front end of the outer plug housing 230, engagement release portions 232, 233 (FIG. 13) are formed that are bent inward to project in the direction B. The engagement release portions 232, 233 are placed so as to contact the front end portions 252*a*, 253*a* of the engaging arms 252, 253. The stopper 240 disposed behind the outer plug housing 230 stops the outer plug housing 230 from moving in the direction B. The stopper 240 is held by the inner plug housing 250 by a hinge and is displaceable between the stop position in the lying state and the stop release position in the upright state. The stopper 240 shown in FIG. 9 is in the stop release position in the state of being erected relative to the inner plug housing 250, while the stopper 240 shown in FIG. 10 is in the stop position in the lying state. When the stopper 240 is in the stop position, the stopper 240 abuts the outer plug housing 230 and thereby prevents the outer plug housing 230 from moving in the direction B.

Figure 11:
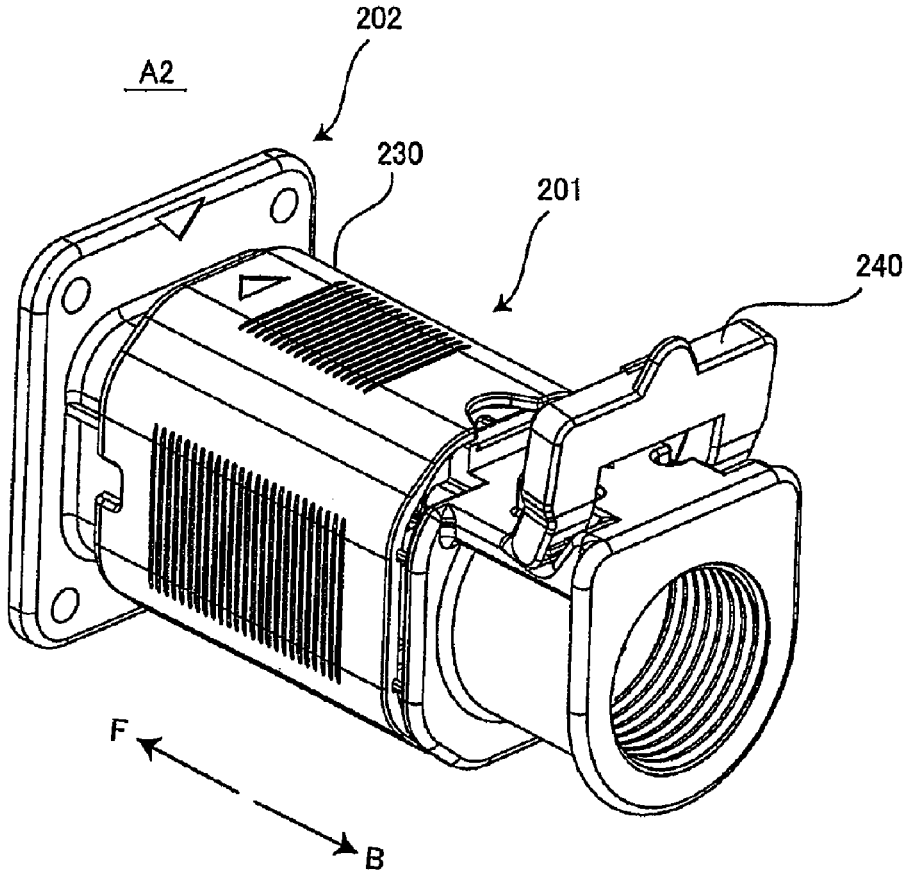
FIG. 11 is a perspective view of the plug connector shown in FIG. 9 in a state where a stopper of the plug connector coupled to a receptacle connector is in a stop release position.
Figure 12:
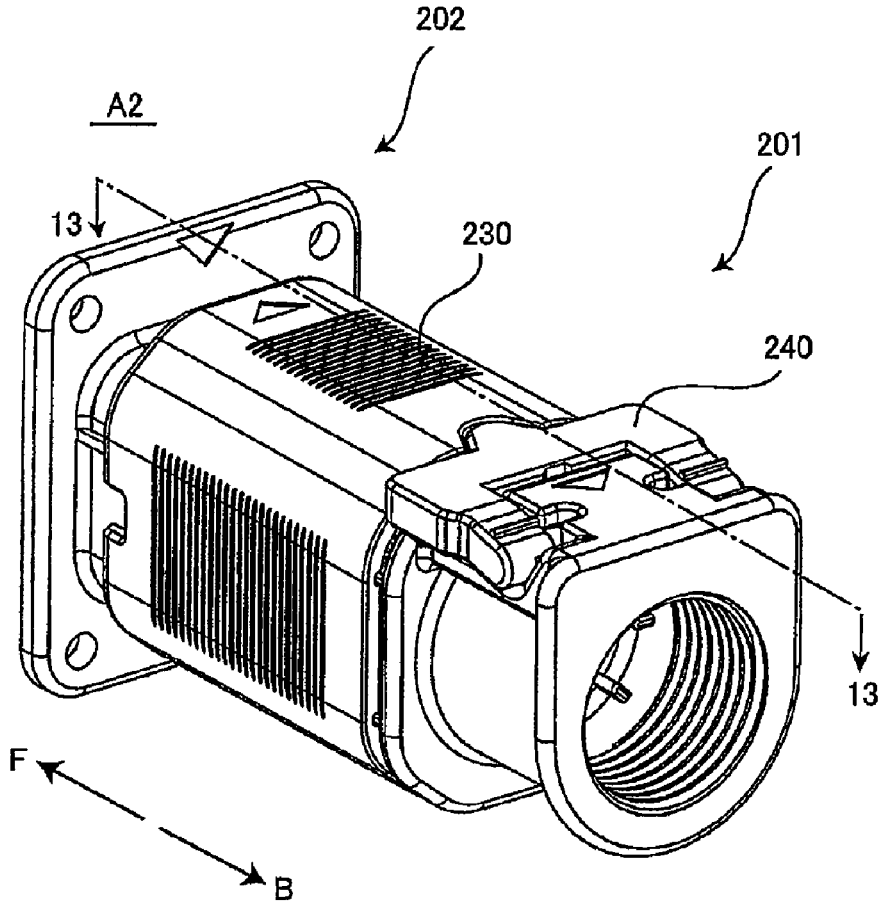
FIG. 12 is a perspective view of the plug connector shown in FIG. 9 in a state where the stopper is in a stop position.
Figure 13:
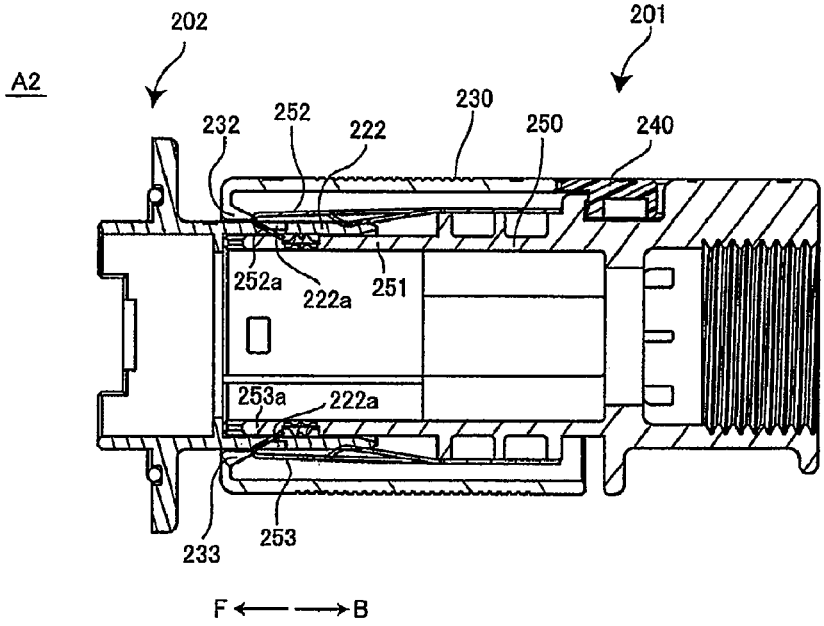
FIG. 13 is a sectional view of the plug connector shown in FIG. 9.

FIG. 11 is a perspective view of the plug connector 201 shown in FIG. 9 in a state where the stopper 240 of the plug connector 201 coupled to the receptacle connector 202 is in the stop release position. FIG. 12 is a perspective view of the plug connector 201 shown in FIG. 11 in a state where the stopper 240 is in the stop position. As shown in FIGS. 11-13, when the plug connector 201 is coupled to the receptacle connector 202, the front end 251 of the inner plug housing 250 is inserted into the hood 222, and the front end portions 252*a*, 253*a* of the engaging arms 252, 253 are fitted in the engaging members 222*a* of the hood 222, which prevents the plug connector 201 from being disconnected.

FIGS. 11-12 show the finished connector assembly A2 in which the plug connector 201 is coupled to the receptacle connector 202. As shown in FIGS. 11-12, when the stopper 240 is in the stop position in the lying state, the outer plug housing 230 is stopped from moving in the direction B even with external force applied thereto, which prevents the outer plug housing 230 from moving to the release position M (FIG. 10). Thus, it is possible to securely prevent the plug connector 201 from being disconnected from the receptacle connector 202. When the stopper 240 is erected by operation to shift to the stop release position (FIG. 11), the outer plug housing 230 becomes displaceable in the direction B. When the outer plug housing 230 moves in the direction B to the release position M (FIG. 10) by operation, the engagement release portions 232, 233 interfere with the engaging arms 252, 253, thereby disengaging the engaging arms 252, 253 from the engaging members 222*a*. When the outer plug housing 230 is further pulled in the direction B by operation, the plug connector 201 is disconnected from the receptacle connector 202.

Figure 14:
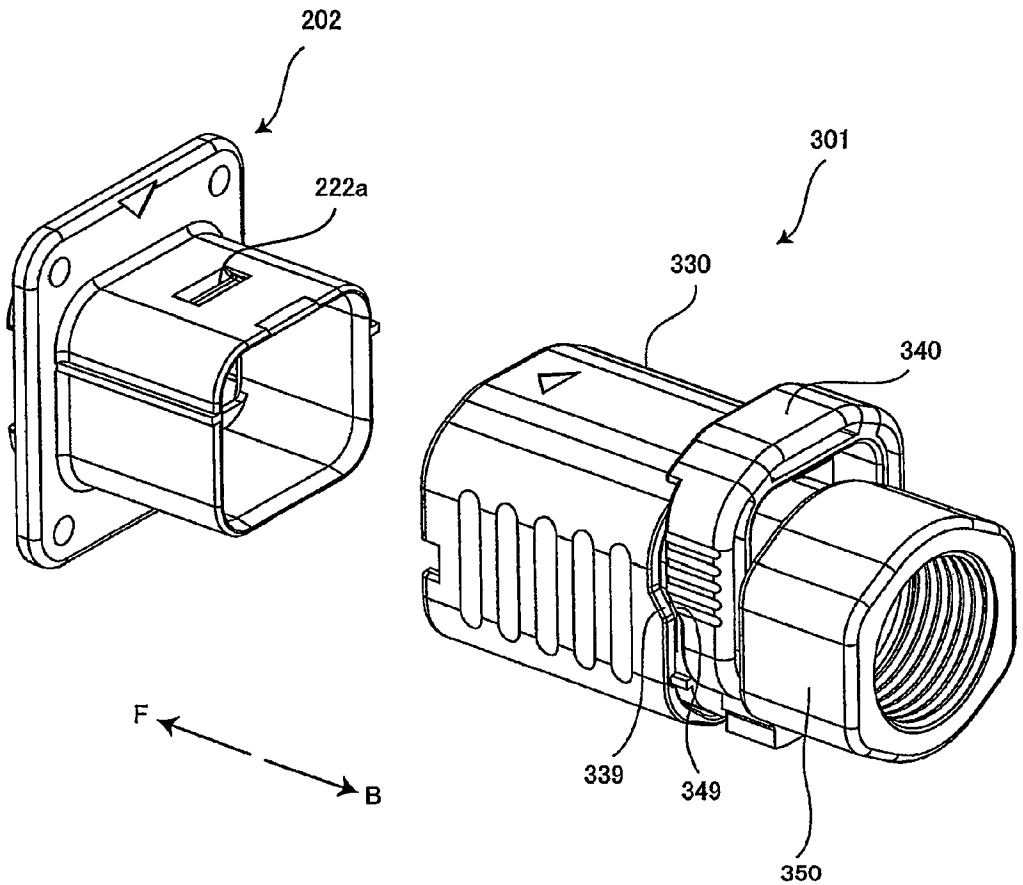
FIG. 14 is a perspective view of a plug connector according to a third embodiment of an electrical connector of the present invention.
Figure 15:
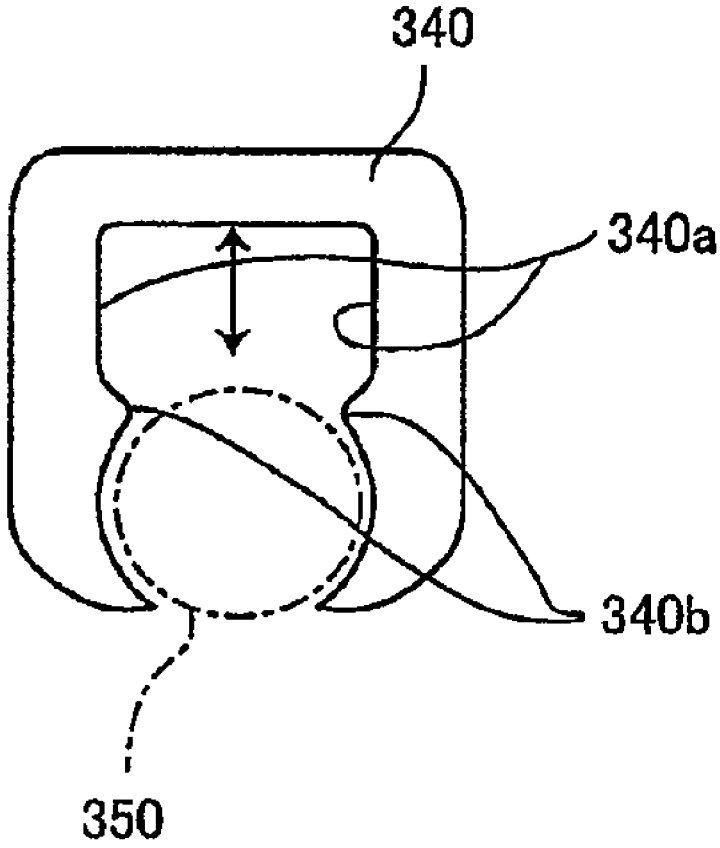
FIG. 15 is a schematic view showing a U-shaped member of the plug connector shown in FIG. 14.
Figure 16:
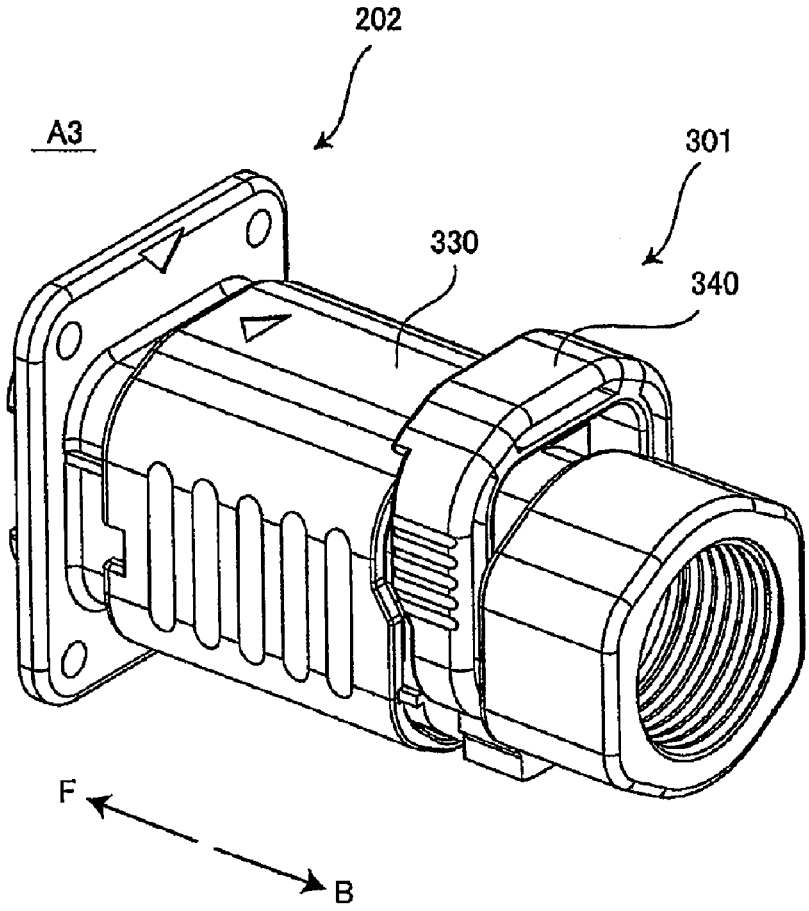
FIG. 16 is a perspective view of the plug connector shown in FIG. 14 in a state where a stopper of the plug connector coupled to a receptacle connector is in a stop release position.

FIGS. 14-16 show a plug connector 301 according to a third embodiment of an electrical connector of the present invention. In the descriptions of the third embodiment, the same elements as those in the first and second embodiments are designated as identical reference symbols and only the feature different from the first and second embodiments will be described.

As shown in FIG. 14, the plug connector 301 and a receptacle connector 202 are coupled to each other, thereby forming a finished connector assembly. The plug connector 301 has a inner plug housing 350 configured to be inserted into the receptacle connector 202, a outer plug housing 330 configured as a tubular member that is disposed outside the inner plug housing 350 that is movable in the direction F and the direction B, a U-shaped member 340 configured as a displacement stop member that prevents displacement of the outer plug housing 330. The inner plug housing 350 of the plug connector 301 is different from the inner plug housing 250 of the second embodiment only in that the rear end is in the shape of a hexagon. It should be noted that various kinds of shapes may be applied to the inner plug housing 350. The outer plug housing 330 is different from the outer plug housing 230 of the second embodiment only in that there is formed a cam follower 339 having an inclined surface on the rear end thereof.

As shown in FIG. 15, the U-shaped member 340 has a pair of arms 340*a* between which the inner plug housing 350 is arranged. The U-shaped member 340 moves in a direction substantially perpendicular to the direction F and the direction B in which the plug connector 301 is inserted in and removed from the receptacle connector 202. The pair of arms 340*a* respectively has protrusions 340*b* that protrude in the direction in which the protrusions 340*b* are opposed to each other. When the U-shaped member 340 moves downward, the protrusions 340*b* slide over the inner plug housing 350. The U-shaped member 340 has a cam surface 349 that abuts the cam follower 339 of the outer plug housing 330.

Figure 17:
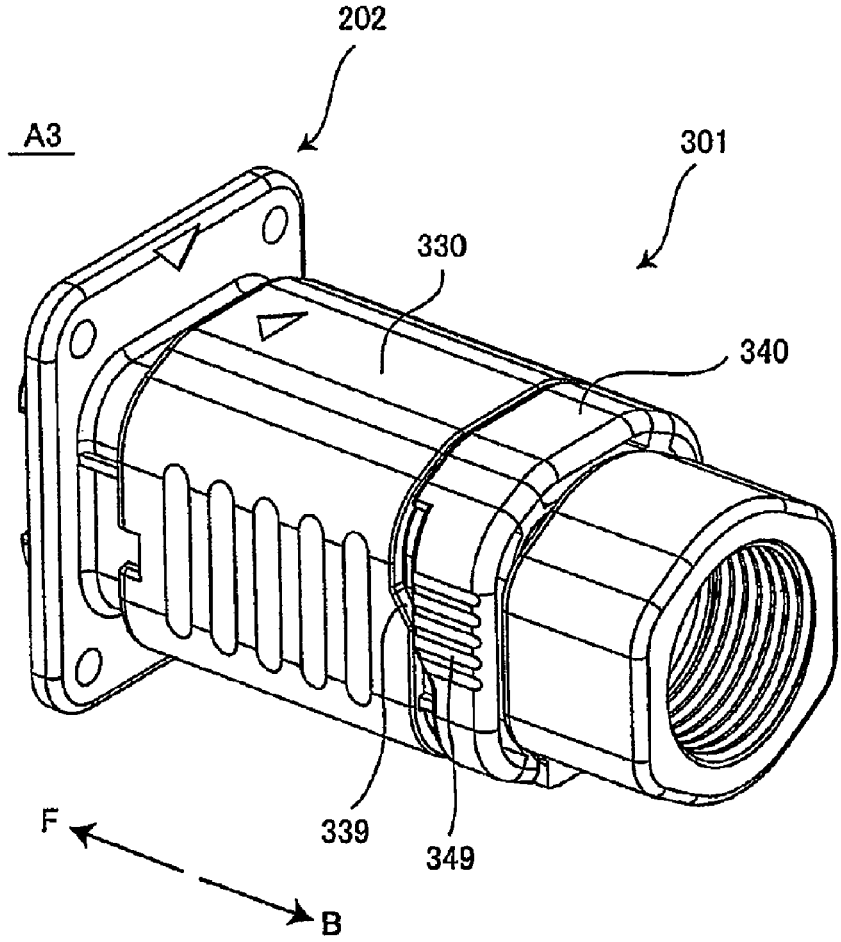
FIG. 17 is a perspective view of the plug connector shown in FIG. 14 in a state where the stopper is in a stop position.

FIG. 16 is a perspective view of the plug connector 301 shown in FIG. 14 in a state where the U-shaped member 340 of the plug connector 301 coupled to the receptacle connector 202 is in the stop release position. FIG. 17 is a perspective view of the plug connector 301 shown in FIG. 16 in a state where the U-shaped member 340 is in the stop position. As shown in FIGS. 16-17, when the plug connector 301 is coupled to the receptacle connector 202, the plug connector 301 is restrained from disconnection. FIGS. 16-17 show a finished connector assembly A3 in which the plug connector 201 is coupled to the receptacle connector 202.

As shown in FIG. 17, when the U-shaped member 340 is in the stop position where the U-shaped member 340 is flush with the outer plug housing 330, the cam follower 339 of the outer plug housing 330 is caused to abut against the cam surface 349 of the U-shaped member 340. In this state, the outer plug housing 330 is stopped from moving to the release position, even with external force applied thereto, which securely prevents disconnection of the plug connector 301. When the U-shaped member 340 is pulled to shift to the stop release position as shown in FIG. 16, the cam surface 349 of the U-shaped member 340 is separated from the cam follower 339, thereby making the outer plug housing 330 displaceable in the direction B. Thus, the engaging arms 252, 253 (FIG. 13) are disengaged from the engaging members 222*a*. When the outer plug housing 330 is further pulled in the direction B by operation, the plug connector 301 is disconnected from the receptacle connector 202.

The foregoing illustrates some of the possibilities for practicing the invention. Many other embodiments are possible within the scope and spirit of the invention. For example, the plug connector 1, 201, 301 in the embodiments has been described as an example of the electrical connector of the present invention. However, the electrical connector of the present invention is not limited to being a plug type and, for example, may be a receptacle type connector. It is, therefore, intended that the foregoing description be regarded as illustrative rather than limiting, and that the scope of the invention is given by the appended claims together with their full range of equivalents.

What is claimed is:

1. An electrical connector, comprising:

an inner plug housing having a front end portion that is received in a hood of a receptacle connector, the hood having at least one engaging member extending therefrom;

an outer plug housing at least partially surrounding the hood, the outer plug housing being displaceable relative to the inner plug housing in a direction of insertion and removal of the inner plug housing from the hood;

at least one engaging arm extending in a space between the outer plug housing and the inner plug housing that engages the engaging member on the hood;

the outer plug housing having an engagement release portion opposing the engaging arm that interferes with the engaging arm to disengage the engaging arm from the engaging member when the outer plug housing is moved in the direction of removal of the inner plug housing from the hood; and a displacement stop member disposed on the inner plug housing that is displaceable between a stop position and a stop release position, the stop position preventing the outer plug housing from moving in the direction of removal of the inner plug housing from the hood and the stop release position releasing the stopping of the outer plug housing from the moving in the direction of removal of the inner plug housing from the hood.

2. The electrical connector of claim 1, wherein the displacement stop member abuts the outer plug housing in the stop position and is separated from the outer plug housing in the stop release position.

3. The electrical connector of claim 1, wherein the engaging member extends from an external wall of the hood.

4. The electrical connector of claim 1, wherein the outer plug housing substantially surrounds the inner plug housing.

5. The electrical connector of claim 1, wherein the displacement stop member is an annular lock ring, the displacement stop member being rotatable about the inner plug housing between the stop position and the stop release position.

6. The electrical connector of claim 5, wherein the displacement stop member includes at least two semi-circular segments.

7. The electrical connector of claim 5, wherein the outer plug housing includes cam pins and the displacement stop member includes a cam surface corresponding to the cam pins, the cam pins and the cam surface interacting to displace the displacement stop member between the stop position and the stop release position.

8. The electrical connector of claim 1, wherein the displacement stop member is a U-shaped member displaceable between the stop release position and the stop position.

9. The electrical connector of claim 5, wherein the displacement stop member extends perpendicular to the direction of insertion and removal of the inner plug housing from the hood in the stop release position and in the stop position.

10. The electrical connector of claim 5, wherein the displacement stop member is rotatable about a hinge.

11. The electrical connector of claim 10, wherein the displacement stop member extends perpendicular to the direction of insertion and removal of the inner plug housing from the hood in the stop release position and parallel to the direction of insertion and removal of the inner plug housing from the hood in the stop position.

* * * * *

UNITED STATES PATENT AND TRADEMARK OFFICE

CERTIFICATE OF CORRECTION

PATENT NO. : 7,632,130 B2
APPLICATION NO. : 12/174784
DATED : December 15, 2009
INVENTOR(S) : Toshiyuki Sami It is certified that error appears in the above-identified patent and that said Letters Patent is hereby corrected as shown below:

Column 9, Claim 9
Line 1, "claim 5" should be -- claim 8 --.

Column 9, Claim 10
Line 5, "Claim 5" should be -- claim 8 --.

Signed and Sealed this

Seventeenth Day of August, 2010

David J. Kappos

David J. Kappos
*Director of the United States Patent and Trademark Office*